United States Patent [19]

Wiener

[11] 4,262,637

[45] Apr. 21, 1981

[54] VAPOR GENERATOR

[75] Inventor: Murray Wiener, Akron, Ohio

[73] Assignee: The Babcock & Wilcox Company, New Orleans, La.

[21] Appl. No.: 65,236

[22] Filed: Aug. 9, 1979

[51] Int. Cl.[3] ..... F22G 7/14

[52] U.S. Cl. ..... 122/478; 122/256; 122/257

[58] Field of Search ..... 122/478, 256, 257, 259, 122/488, 6 A

[56] References Cited

U.S. PATENT DOCUMENTS

| | | | |
|---|---|---|---|
| 1,875,792 | 9/1932 | Yarrow | 122/478 X |
| 1,917,617 | 7/1933 | Ulrich | 122/478 X |
| 2,114,224 | 4/1938 | Jacobus | 122/478 X |
| 2,648,397 | 8/1953 | Ravese et al. | 122/488 X |
| 2,763,245 | 9/1956 | Place | 122/488 |

*Primary Examiner*—Edward G. Favors

*Attorney, Agent, or Firm*—R. J. Edwards; R. C. Mai

[57] ABSTRACT

A pair of parallel fluid flow connected steam-water drums and associated piping for natural or assisted circulation steam generators including downcomer pipes for receiving water from the drums and being disposed below and in equispaced relationship with the drums. A plurality of supply tubes for connecting the downcomer pipes with each drum, the supply tubes being equally divided between the drums; and a plurality of riser tubes for delivering a steam-water mixture to the drums, the riser tubes being equally divided between the drums.

4 Claims, 2 Drawing Figures

VAPOR GENERATOR

TECHNICAL FIELD

The present invention relates to steam generators, and more particularly to an improved twin steam-water drum arrangement for natural and assisted circulation steam generators.

BACKGROUND ART

The output of present day high pressure drum type steam generators for utility application is limited by the size and weight of the steam-water drum which can be shipped from the manufacturing facilities to the erection site. In very large steam generators, the drum length required to accommodate the necessary steam-water separating equipment may exceed 120 feet and its weight could be more than 500 tons. Needless to say, a drum of this size is very difficult to transport to the erection site and to install on a steam generator.

An arrangement of two steam-water drums connected in series has been used by the prior art when faced with crude and inefficient steam-water separating equipment. This series arrangement requires that the steam-water mixture flowing from the generating tubes be first introduced into one of the two steam-water drums for primary separation of steam and water. The separated moisture laden steam is then conveyed to the other steam-water drum for secondary separation and the drying of the separated steam. This series arrangement of steam-water drums wherein primary and secondary separation of steam and water takes place in separate drums is too costly since it permits only a slight reduction in the size of each drum relative to that of a drum capable of accommodating both steam-water separating stages.

An arrangement of two steam-water drums connected in parallel has been used by the prior art as disclosed in Bell, U.S. Pat. No. 1,036,517; Ulrich, U.S. Pat. No. 1,917,617 and Stevens, U.S. Pat. No. 3,662,716. However, this parallel arrangement does not provide for uniform distribution of steam and water to and from each drum. For example, the riser tubes delivering steam to the drums are routed for layout convenience rather than uniform distribution between drums thereby leading to non-uniform steam output from each drum. In cases where each drum is provided with its own downcomer pipes, the non-uniform steam output leads to different enthalpies in the water flowing through the downcomer pipes from each drum to the various furnace generating circuits and causes non-uniform circulation rates through these circuits thereby resulting in unequal steam delivery to the two drums. This prior art arrangement encounters large water level difference in each drum that affects the separation of steam and water and leads to undesirable water level fluctuations and associated difficulties of water level control.

SUMMARY OF THE INVENTION

The present invention is concerned with providing an arrangement of twin steam-water drums connected in parallel and having a steam output capacity equal to that of a single steam-water drum of considerably greater length and weight than either of the twin drums. The arrangement is suitable for application with either natural or assisted circulation steam generators and functions as one drum thereby being adaptable to water level control from a single water level regulator. Close control of the water level in steam-water drums is very essential to the performance of the steam-water separating equipment and to the circulation in the furnace steam generating circuits. The use of a single water level regulator simplifies the operation of the controls and results in considerable economies by obviating the necessity for separate feedwater flow regulating valves and associated driving and control devices for each drum.

Accordingly, there is provided an arrangement including a pair of steam-water drums with each drum having an upper steam space and a lower water space. A plurality of tubes is interposed between the drums and connects the steam and water spaces respectively. A plurality of downcomer pipes receives water from the drums, and is disposed below and in equispaced relationship with respect to the drums. A plurality of supply tubes connects the downcomer pipes with each drum. The supply tubes for each downcomer pipe being eqally divided between the drums. A plurality of generating tubes supplies a steam-water mixture for delivery to the drums. Headers receive the steam-water mixture from the generating tubes, and a plurality of riser tubes connects the headers with each drum. The riser tubes for each header are equally divided between the drums. Alternatively, the riser tubes may be directly connected at one end to the generating tubes and having their opposite ends connected to the drums and equally divided between the drums.

DETAILED DESCRIPTION OF THE PREFERRED EMBODIMENT

Figure 1:
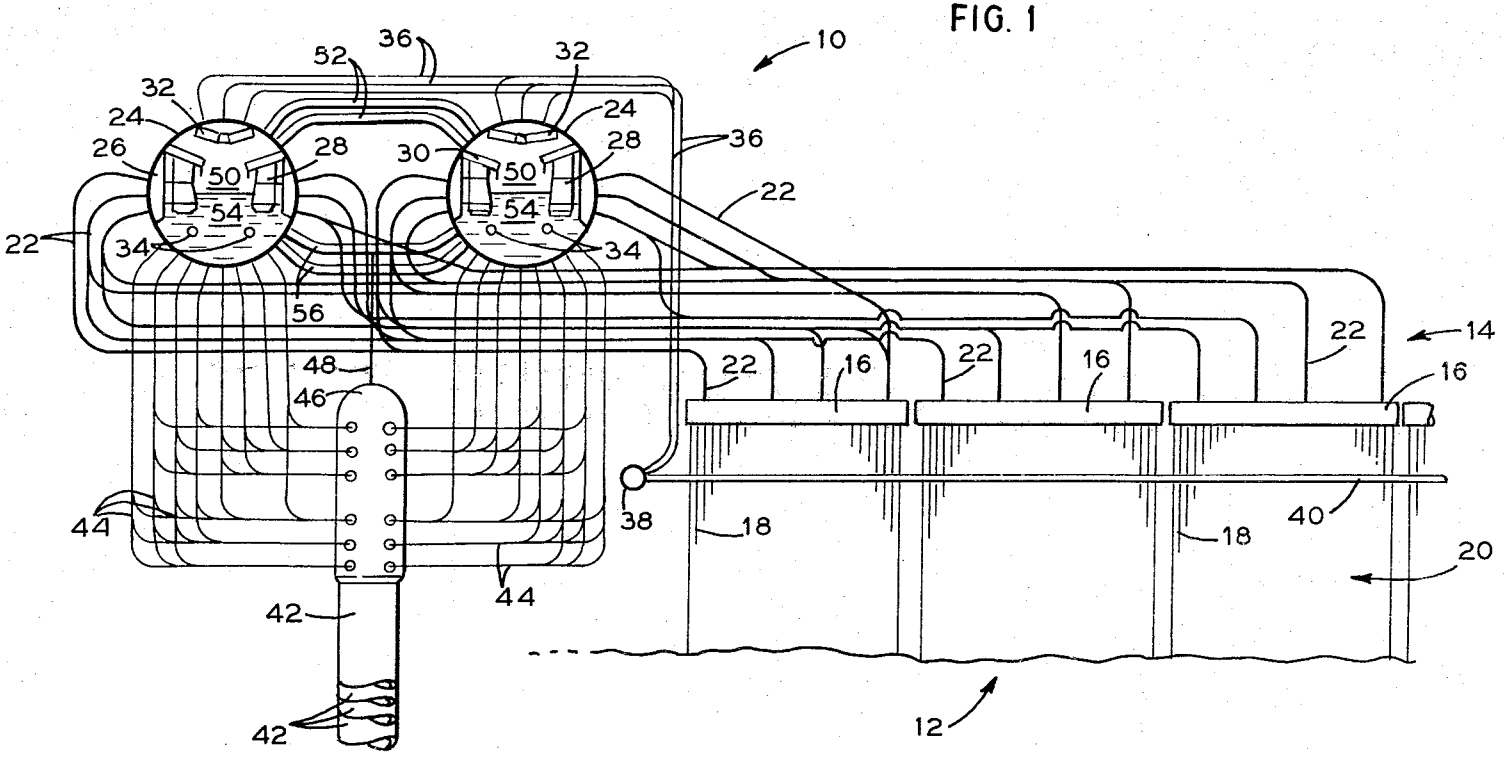
FIG. 1 is a diagrammatic sectional elevation view of a twin steam-water drum arrangement embodying the invention.

Referring to FIG. 1 of the drawings, there is diagrammatically shown a twin steam-water drum arrangement 10 and an upper portion of the furnace side wall 12 of a natural circulation vapor generating unit 14. Since the construction and arrangement of the tube wall panels, associated headers and riser tubes are substantially the same for all of the furnace walls, it will suffice to describe the system corresponding to the side wall 12.

In accordance with the invention, each of the outlet headers 16, which is connected to the steam generating tubes 18 of furnace side wall panels 20, is provided with an even number of riser tubes 22 having equal cross-sectional flow areas and being equally divided between the two steam-water drums 24 and alternately connected thereto. This insures equal distribution of the steam-water mixture being supplied to the drums 24 at all operating conditions and minimizes flow unbalances resulting from variations in heat distribution caused by combustion upsets. The riser tubes 22 are distributed along the length of the respective drums 24 so that the steam-water mixture is supplied uniformly to the collection chambers 26 and thence to the cyclone type steam-water separators 28 located within the drums 24 thereby enhancing separator efficiency and thus allowing the use of shorter drums. Although not shown on the drawing, the riser tubes 22 may be directly connected at one end to the steam generating tubes 18, forming in effect an extension of the steam generating tubes 18, the opposite ends of the riser tubes 22 being connected to the drums and equally divided between the drums.

The two steam-water drums 24 are of equal size and equal length. The number and size of connections to the drums are equal and symmetrically distributed. The drum internals which include the cyclone type steam-water separators 28, the primary and secondary steam scrubbers or driers 30 and 32, the feedwater pipes 34, and the blowdown, and chemical feed and the steam sampling pipes, not shown, are identical for both drums 24. The number and size of safety valves placed on each drum are the same. The safety valves, not shown, are set in pairs to relieve at equal pressures, with one valve of the pair being located at one end of the first drum and the other valve of the same pair being located at the opposite end of the second drum.

The saturated steam leaving the secondary scrubbers 32 is discharged from the steam-water drums 24 through the saturated steam tubes 36 which are of equal cross-sectional flow area and are routed in pairs and equally divided between the drums 24 to insure equal steam flow from the drums 24. The saturated steam tubes 36 discharge to the roof inlet header 38 which supplies steam to the roof tubes of the like shown at 40.

In accordance with the invention, the downcomer pipes 42, which are distributed lengthwise of the steam-water drums 24, are not connected directly to the drums 24 but interconnect therewith through a plurality of downcomer supply tubes 44 of equal cross-sectional flow area. The supply tubes 44 for each downcomer pipe 42 are equally divided between the drums 24. The downcomer pipe 42 is of relatively large cross-sectional flow area when compared to the cross-sectional flow area of a supply tube 44. The downcomer pipes 42 are of equal cross-sectional flow area and are disposed below and in equispaced relationship with respect to each drum 24. Each downcomer pipe 42 is formed with an inlet or collecting bottle 46 at the top and an outlet or distributing bottle at the bottom, not shown. Each collecting bottle 46 is provided with a vent 48. Each downcomer pipe 42 has a cross-sectional flow area which is smaller than the total cross-sectional flow area of the supply tubes 44 connected thereto, so that the water velocity through the supply tubes 44 is lower than the water velocity through the downcomer pipes 42. The supply tubes 44 are routed as short as possible with the least number of bends so as to prevent flashing. Furthermore, the supply tubes 44 are arranged symmetrically with respect to both drums 24 to insure equal water flow from the drums 24 to each downcomer pipe 42 and to provide a fully mixed water enthalpy to all downcomer pipes 42. The use of multiple supply tubes 44 from the steam-water drums 24 to the downcomer pipes 42 eliminates water gradients along the drums 24.

The steam spaces 50 of the two steam-water drums 24 are interconnected by the steam space connecting tubes 52 which are uniformly spaced along the longitudinal extent of the drums 24 to minimize and limit the water level difference resulting from minute steam pressure difference in the respective steam spaces 50 of the drums 24. Such pressure differences may arise if the steam input to each drum or the steam output from each drum is not exactly equal. The steam space connecting tubes 52 serve to equalize the pressure in the steam spaces 50 of the two drums, and are sized to minimize water level difference caused by any uneven steam output from the drums 24.

The water spaces 54 of the two steam-water drums 24 are interconnected by water space connecting tubes 56 which are uniformly spaced along the longitudinal extent of the drums 24 and are disposed slightly below the lowest acceptable water level position in the drum. The water space connecting tubes 56 limit the drum water level variations between the drums 24. It should be recognized that the efficacy of the cyclone type steam separators 28 depends on maintaining the water level in the drum at a given level, generally referred to as "normal water level." Only small variations from the normal water level are allowed, usually between ±6 in. to ±9 in. Water level differences in the drums may occur mainly due to differences in water quantities in the steam-water mixture delivered by the riser tubes 22 as a result of variations in heat absorption between the furnace wall panels 20. Water level variations may also be due to differences in the distribution of feedwater to the drums 24. A momentary rise or drop in water level may occur at transient conditions, such as during rapid load changes or a sudden change in firing rate, etc., or when a shrink or swell of the fluid in the circulatory system develops as a result of a sudden change in pressure.

Figure 2:
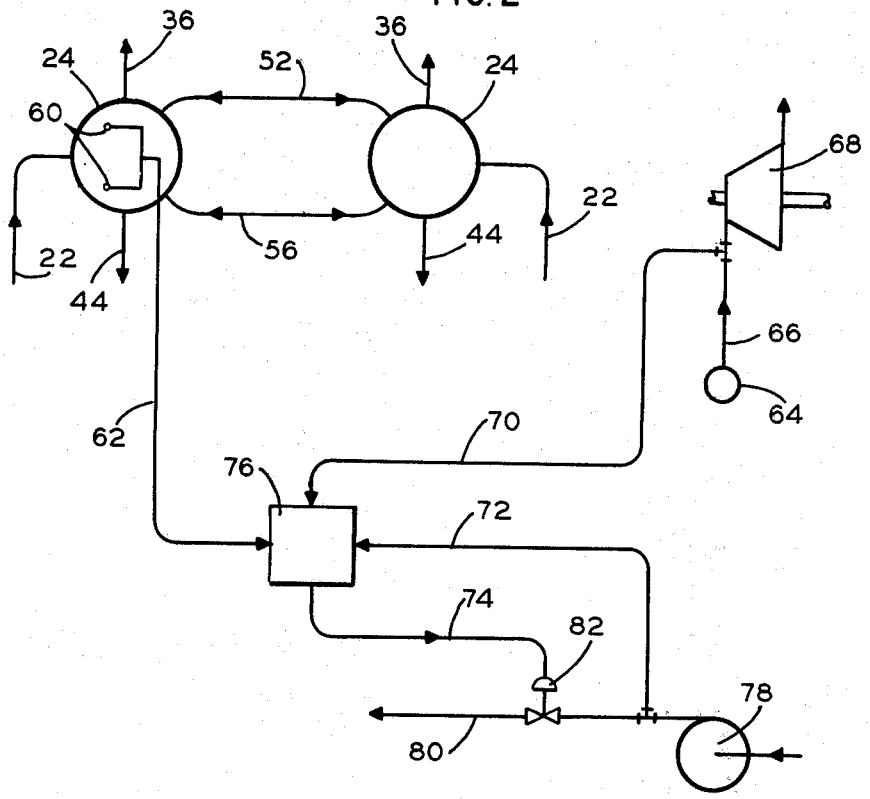
FIG. 2 is a schematic representation of one feedwater regulator controlling the water level in twin steam-water drums.

Referring to FIG. 2, shown is a schematic representation of a single three-element feedwater control 76 receiving a control signal 62 from one of the twin steam-water drums 24 and thereby controlling the water level in both drums 24 because of the perfect balance of circuitry and pressure equalization between the drums as previously described. The control signal 62 is generated in a manner known in the art by water level connections 60 installed in one of the drums. A second control signal 70 is generated by total steam flow from superheater outlet header 64 to high pressure steam turbine 68 through main steam outlet line 66. A third signal 72 is generated by total feedwater flow in line 80 from boiler feed pump 78 which connects to an economizer inlet header, not shown, providing water input to the steam generating system. The combination of signal inputs from lines 62, 70 and 72 to feedwater level controller 76 results in a control signal through line 74 to actuate control valve 82 or pump 78 speed in response to and including control signal 62.

In the operation of a twin drum steam generator of the character embodying the present invention, the feedwater quantity delivered to each of the drums 24 must be equal at all times and must be uniformly distributed along the length of each drum. To achieve uniform feedwater distribution, the feed-water pipes 34 are provided with an equal number of drilled holes, not shown, uniformly spaced along the drums 24. The feedwater temperature must be at least 60° F. below saturation temperature so that the water jetting from the feedwater pipes 34 condenses the carry-under-steam from the separators 28. The highly subcooled feedwater mixes with the condensed carry-under-steam and the saturated water discharging from the separators 28 to maintain the mixture below saturation temperature. The combination of water below saturation temperature and low flow velocities through the downcomer supply tubes 44 insures that no flashing can occur in the supply tubes 44. Flashing in the supply tubes 44 can greatly impair the steam generator circulating flow rates. The water discharging from the downcomer pipes 42 is conveyed to the inlet headers, not shown, of the furnace tube wall panels 20. The water flows upwardly through the wall panel tubes 18 and is heated to a steam-water mixture by indirect heat exchange with combustion gases flowing through the furnace. The steam-water mixture discharges into headers 16 or directly into riser tubes 16 and is then conveyed in substantially equal quantity to the collection chambers 26. The steam-water mixture passes from the collection chambers 26 through the cyclone type separators 28 wherein the steam and water are separated with the steam being discharged through the primary scrubbers 30 to the steam spaces 50 and then through the secondary scrubbers 32 and through the saturated steam tubes 36 to the roof inlet header 38 and then to the roof tubes of the like shown at 40. The water leaving the separators 28 is discharged to the water spaces 54 to be conveyed by the supply tubes 44 to the downcomer pipes 42 and then to the furnace tube wall panels 20 for further heating.

In accordance with the present invention, any water level difference between the drums 24 is equalized within a short time along two water flow paths. The first path is through the supply tubes 44 to the downcomer pipes 42, wherein the drum having the higher water level will discharge more water to the downcomer pipes 42 than the drum with the lower water level. The second path is through the water space tubes 56 wherein the flow of water between drums will always be in the direction of the drum having the lower water level. The second path is relatively short thereby permitting a rapid equalization of water levels. It has been determined that a 6 in. difference in drum water levels will reduce itself to nearly zero in a few seconds depending on the number and size of interconnecting tubes.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. In combination with a steam generator including:

a pair of steam-water drums, each drum having an upper steam space and a lower water space, tubes uniformly interposed between the drums for connecting the steam and water spaces respectively, downcomer pipes of equal cross-sectional flow area for receiving water from the drums, the downcomer pipes being disposed below and in equispaced relationship with respect to the drums, supply tubes of equal cross-sectional flow area connecting the downcomer pipes with each drum, the supply tubes for each downcomer pipe being arranged symmetrically with respect to both drums and equally divided between the drums, the total cross-sectional flow area of the supply tubes connected to each downcomer pipe being greater than the cross-sectional flow area of the downcomer pipe, generating tubes for supplying a steam-water mixture for delivery to the drums, headers, flow connected to the generating tubes, and riser tubes of equal cross-sectional flow area disposed to receive the steam-water mixture from the headers, the riser tubes being alternately routed and equally divided between said drums and connected thereto.

2. The combination according to claim 1 including tubes connected to the drums for conveying steam therefrom, the steam conveying tubes being equally divided between said drums and having equal cross-sectional flow areas.

3. The combination according to claim 1 wherein the water level in each drum is controlled by one feedwater regulator connected to one of the drums.

4. The combination according to claim 1 including an even number of riser tubes for each header.

* * * * *